US006325728B1

(12) United States Patent
Helmstetter et al.

(10) Patent No.: US 6,325,728 B1
(45) Date of Patent: Dec. 4, 2001

(54) FOUR FACETED SOLE PLATE FOR A GOLF CLUB HEAD

(75) Inventors: Richard C. Helmstetter, Rancho Santa Fe; Roger C. Cleveland, Los Angeles; D. Clayton Evans, San Marcos; Garth W. Smith, Vista, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/606,661

(22) Filed: Jun. 28, 2000

(51) Int. Cl.[7] ..... A63B 53/04
(52) U.S. Cl. ..... 473/328; 473/345
(58) Field of Search ..... 473/324, 327, 473/328, 345, 346, 349, 290, 291, 344; D21/733, 752, 759

(56) References Cited

U.S. PATENT DOCUMENTS

| | | | |
|---|---|---|---|
| D. 307,783 | | 5/1990 | Iinuma . |
| D. 318,087 | | 7/1991 | Helmstetter . |
| D. 402,726 | | 12/1998 | McCabe et al. . |
| 1,619,566 | | 3/1927 | Crankshaw . |
| 1,868,286 | | 7/1932 | Grieve . |
| 3,761,095 | | 9/1973 | Thompson . |
| 4,332,388 | | 6/1982 | Crow . |
| 5,042,806 | | 8/1991 | Helmstetter . |
| 5,240,252 | | 8/1993 | Schmidt et al. . |
| 5,314,185 | | 5/1994 | Gorman . |
| 5,326,105 | * | 7/1994 | Fenton . |
| 5,460,376 | * | 10/1995 | Schmidt . |
| 5,547,188 | | 8/1996 | Dumontier et al. . |
| 5,573,469 | | 11/1996 | Dekura . |
| 5,800,285 | * | 9/1998 | Thorne . |
| 5,839,975 | * | 11/1998 | Lundberg . |
| 6,001,027 | * | 12/1999 | Hansberger . |
| 6,007,433 | | 12/1999 | Helmstetter et al. . |
| 6,056,649 | | 5/2000 | Imai . |

OTHER PUBLICATIONS

U.S. Trademark Registration Nos. 1947849; 1922181; 1918108; 75–560691; 75–721732; 75–230445; 74–486625; 74–690024; 75–627646; And 75–627513.

* cited by examiner

*Primary Examiner*—Sebastiano Passaniti
(74) *Attorney, Agent, or Firm*—Michael A. Catania

(57) ABSTRACT

A four faceted sole for a high performance, large volume golf club head is disclosed herein. The sole has a central facet, a heel facet, a toe facet and a rear facet. The central facet occupies 50 to 70 percent of the total sole surface area. The toe facet, the heel facet and the rear facet are all preferably angled relative to the central facet. The four faceted sole allows for a lower center of gravity for the golf club head and a specific moment of inertia.

19 Claims, 5 Drawing Sheets

FOUR FACETED SOLE PLATE FOR A GOLF CLUB HEAD

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to golf clubs. More specifically, the present invention relates to a sole plate for a golf club head.

2. Description of the Related Art

In general, a golf club head has four components: a face, a crown, a sole and a hosel for receiving a shaft. The sole has a greater affect on the club head performance in a driver or fairway than in an iron or putter. Also, as golf club heads have increased in volume, the sole has been modified to maintain or increase the performance of these larger golf club heads.

The prior art of sole variations for woods and utility clubs is fairly limited. It is reported by Jeffrey Ellis on page 263 of his book, *The Clubmaker's Art*, that the convex sole for a golf club head was invented by Willie Dunn, Jr., for which Dunn received British Patent Number 22,574 in 1891. Dunn's convex sole was an improvement over the flat soles of the time. Another development in golf club soles was Crankshaw, U.S. Pat. No. 1,619,566 for a "V" sole that has its apex on the centerline of the driving face. Another example is Grieve, U.S. Pat. No. 1,868,286, for a golf club sole that had a "T" shaped metal ridge. Yet another example is Thompson, U.S. Pat. No. 3,761,095 for a Golf Club Head With Sole Plate-Keel Attachment, filed in 1972, and which was assigned to Callaway Golf. The Thompson utility club, marketed under the name, GINTY®, was directed to minimizing the ground contact area through use of the keel. A further example is Crow, U.S. Pat. No. 4,332,388 which was filed in 1980 for a golf club with a metal sole plate that has a pair of parallel runners to skid on the ground surface with minimum penetration. Although there were variations in the sole of persimmon woods, as evidenced by the above, the vast majority of persimmon woods had relatively flat soles.

One of the first metal woods to have a variation in its sole was the Callaway Golf S2H2® golf club, set forth in Helmsetter, U.S. Pat. No. Des 318,087, filed in February of 1989 for a sole with four facets on a golf club head that had a volume of less than 190 cubic centimeters.

Another metal wood sole is the WARBIRD® sole of the GREAT BIG BERTHA® driver that was sold by Callaway Golf, and as set forth in U.S. Pat. No. 5,240,252, filed in January of 1992. The WARBIRD® sole had a medial ridge defining two concave side recesses and also had a concave rear recess to lessen the drag forces during a golf swing and to strengthen the sole walls.

Another sole is set forth in Gorman, U.S. Pat. No. 5,314,185. The Gorman patent discloses a sole with two parallel struts to raise the center of gravity. Dumontier, et al., U.S. Pat. No. 5,547,188, discloses a sole that has a rib with two diverging branches and an attack edge, and where the branches change divergence width with changes in the loft angles. Dekura, U.S. Pat. No. 5,573,469, originally filed in Japan in 1994, discloses a sole with a convex portion for stability during address so that the face may be properly oriented for striking a golf ball. McCabe, et al., U.S. Pat. No. Des 402,726 discloses a sole that has two recesses nearest the rear. Imai, U.S. Pat. No. 6,056,649, originally filed in Japan in 1997, discloses a sole with two weighted protrusions for lowering the center of gravity.

Another distinctive sole is the sole of the GREAT BIG BERTHA® HAWK EYE® golf club, and as set forth in Helmstetter, U.S. Pat. No. 6,007,433, filed in April of 1998. The HAWK EYE® sole has a medial ridge with two lateral extensions that define two downwardly convex recesses. Other soles that have some relation to the above-mentioned prior art are set forth in U.S. Trademark Registrations 1947849, 1922181, 1918108, 2300297, 2046904, and 2013319.

However, there remains a need for a sole for new golf club heads due to the increased volume of golf club heads, and the high performance nature of golf club heads (as measured by driver distance). The prior art soles, although adequate and performance enhancing, do not optimize the benefits of a high performance, large volume golf club head.

BRIEF SUMMARY OF THE INVENTION

The present invention is able to provide a sole that is designed for a high performance, large volume golf club head. The present invention is able to accomplish this by providing a four faceted sole that allows for a lower center of gravity and a high performance design moment of inertia.

One aspect of the present invention is a sole for a golf club head having a crown, a toe end, a heel end and a striking plate. The sole includes a central facet, a heel facet, a toe facet and a rear facet. The central facet extends rearward from the striking plate, and has a first sole area. The heel facet is disposed adjacent to the central facet and has a second sole area. The toe facet is disposed adjacent to the central facet and has a third sole area. The rear facet is disposed rearward of the central facet and has a fourth sole area. The first sole area is larger than the combined areas of the second sole area, the third sole area and the fourth sole area.

Another aspect of the present invention is a golf club head having a body with a volume greater than 300 cubic centimeters, a hollow interior, and composed of a forged metal material. The body also has a crown, a striking plate, a ribbon, a heel end, a toe end and a sole. The sole includes a central facet, a heel facet, a toe facet and a rear facet. The central facet extends rearward from the striking plate, and has a first sole area ranging from 4.0 to 6.0 square inches. The heel facet is disposed adjacent to the central facet, angled toward the ribbon relative to the central facet, and has a second sole area ranging from 1.0 to 2.0 square inches. The toe facet is disposed adjacent to the central facet, angled toward the ribbon relative to the central facet, and has a third sole area ranging from 1.0 to 2.0 square inches. The rear facet is disposed rearward of the central facet, angled toward the ribbon relative to the central facet, and has a fourth sole area ranging from 0.5 to 2.0 square inches.

It is a primary object of the present invention to provide a four faceted sole for a golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
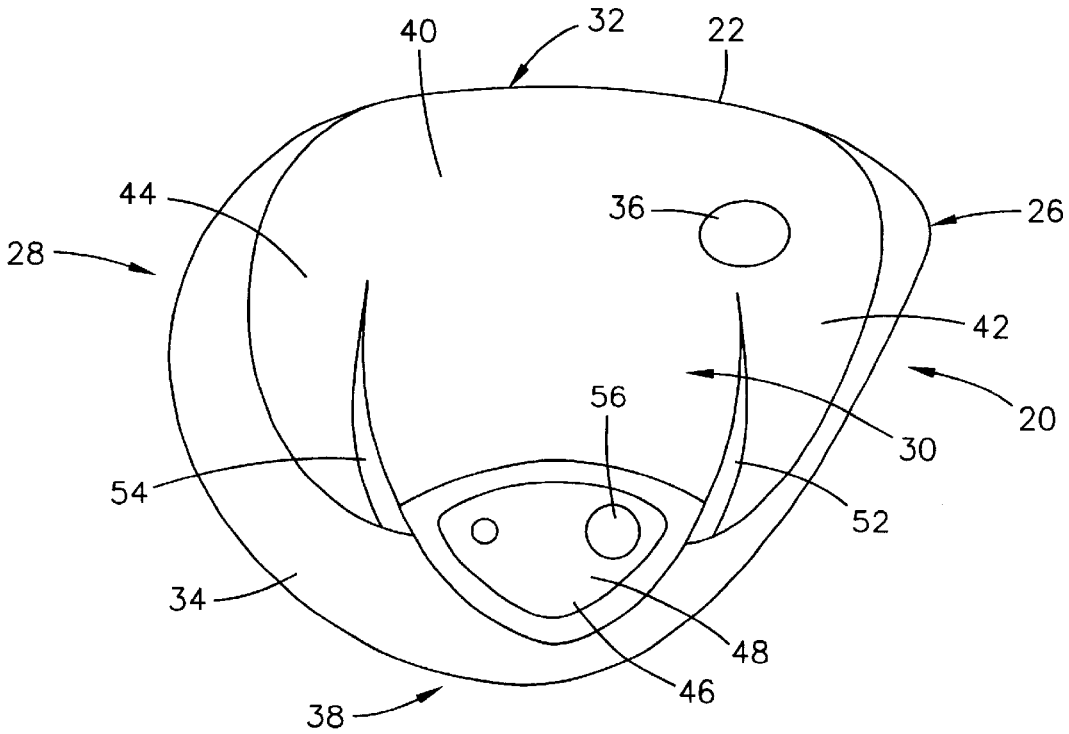
FIG. 1 is a bottom plan view of the sole of the golf club head of the present invention.
Figure 2:
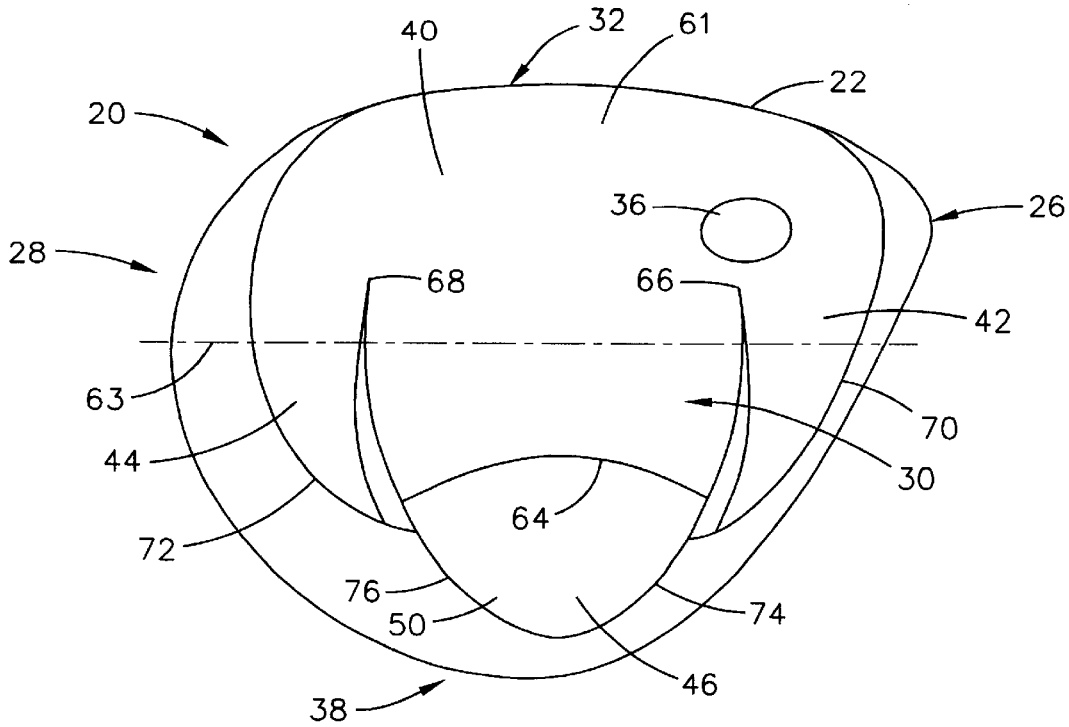
FIG. 2 is a bottom plan view of the sole of the golf club head of the present invention with a medallion positioned within a rear facet recess.

As shown in FIGS. 1–9, the golf club head of the present invention is generally designated 20. The golf club head 20 is a fairway wood or a driver. The golf club head has a body 22 that is preferably composed of a metal material such as titanium, titanium alloy, stainless steel, or the like, and is most preferably composed of a forged titanium material. However, the body 22, or a portion of the body 22, may be composed of a graphite composite material or the like. The body 22 preferably has a large volume, most preferably greater than 300 cubic centimeters, and is most preferably 350 cubic centimeters for a body composed of titanium. However, a body 22 composed of stainless steel may have a volume range of 200 cubic centimeters to 275 cubic centimeters, and a body 22 composed of a composite material may have a volume of 325 cubic centimeters to 400 cubic centimeters. The body 22 preferably weighs no more than 215 grams, and most preferably weighs between 180 and 205 grams. The body 22 has a hollow interior 23.

The body 22 has a crown 24, a heel end 26, a toe end 28, a sole 30, a striking plate 32 and a ribbon 34. A shaft, not shown, is placed within a hosel, not shown, at the heel end 26. In a preferred embodiment, the hosel is internal to the body 22, and the shaft extends to the sole 30 at a bore 36. The body 22 also has a rear section 38 that is opposite the striking plate 32.

The sole 30 of the present invention is designed to function in a high performance, large volume driver or fairway wood. Such a high performance, large volume driver or fairway wood is designed for compliance during impact with a golf ball in order to reduce the energy loss for greater distance. Such a driver or fairway wood is disclosed in co-pending U.S. patent application Ser. No. 09/431,982 filed on Nov. 01, 1999 for a Golf Club Head With A Forged Titanium Striking Plate, which is hereby incorporated by reference in its entirety. The sole 30 of the present invention is able to function in a high performance, large volume driver due to its unique four facet structure.

The sole 30 of the present invention has a central facet 40, a heel facet 42, a toe facet 44 and a rear facet 46. The rear facet 46 preferably defines a recess 48 that is covered by a medallion 50. Due to the angle to the central facet 40, the heel facet 42 and the toe facet 44 have a transition edge 52 and 54 respectively. The rear facet 46 is also angled to the central facet 40, and is used for access to the hollow interior 23 of the body 22 through a portal 56.

Figure 4:
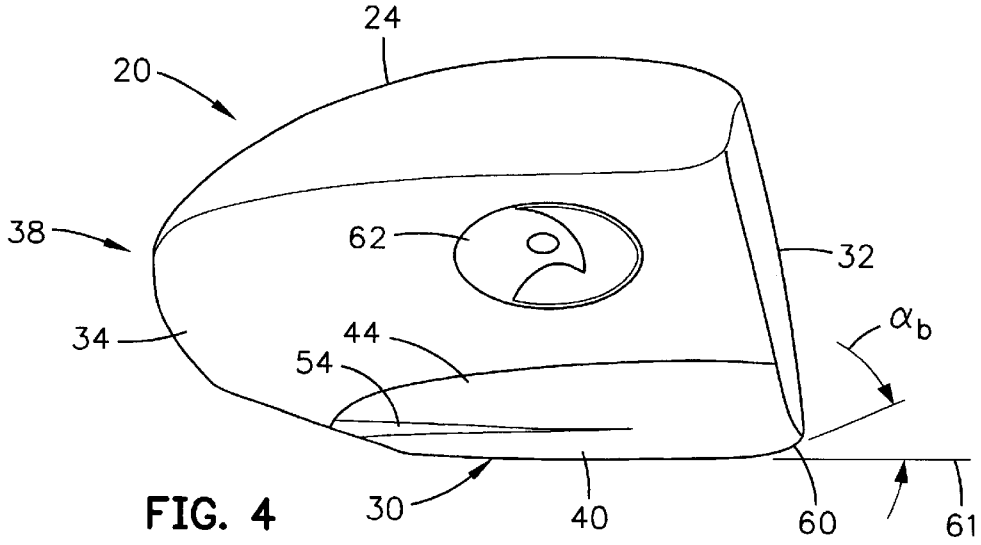
FIG. 4 is a side view of the toe end of the golf club head of the present invention.
Figure 5:
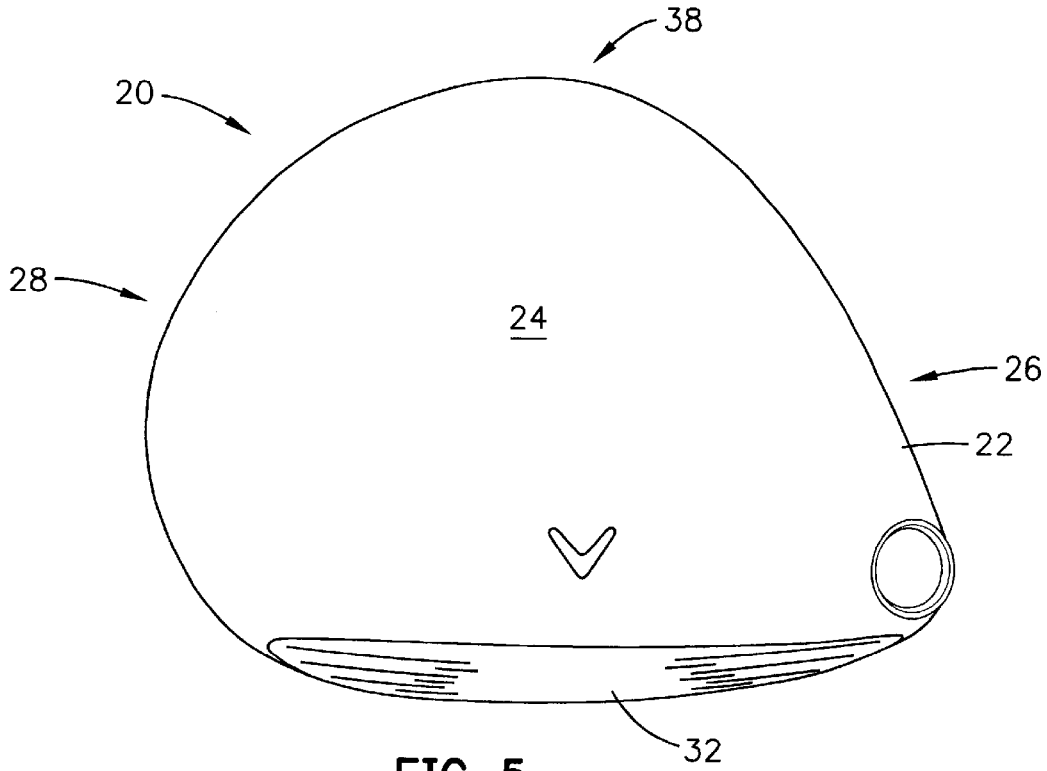
FIG. 5 is a top plan view of the golf club head of the present invention.

The central facet 40 has a bounce edge 60 nearest the striking plate 32. The bounce edge 60 prevents or substantially reduces ground interference during a golf swing. The bounce edge 60 is preferably at an angle, angle $\alpha_b$ as shown in FIG. 4, of between 10 to 30 degrees relative to a central longitudinal line 61, and is most preferably at an angle of 25 degrees relative to a central longitudinal line 61. The central facet 40 is defined by the bounce edge 60, an arcuate edge 64 adjacent the rear facet 46, a heel curved edge 66 adjacent the heel facet 42, and a toe curved edge 68 adjacent the toe facet 44. The central facet 40 preferably has a first sole area that ranges from 4.0 to 6.0 square inches, and more preferably ranges 4.75 square inches to 5.25 square inches, and is most preferably 5.1 square inches. The central facet 40 preferably occupies between 50 to 70 percent of the total sole surface area, more preferably 55 to 65 percent of the total surface area, and most preferably 57 percent of the total sole surface area.

The heel facet 40 is defined by a portion of the bounce edge 60, the heel curved edge 66 adjacent the central facet 40, and a heel-ribbon edge 70 adjacent a portion of the ribbon 34. The heel facet 42 preferably has a second sole area that ranges from 1.0 to 2.0 square inches, and more preferably ranges 1.25 square inches to 1.75 square inches, and is most preferably 1.5 square inches. The heel facet 42 preferably occupies between 10 to 25 percent of the total sole surface area, more preferably 15 to 20 percent of the total surface area, and most preferably 17 percent of the total sole surface area.

The toe facet 44 is defined by a portion of the bounce edge 60, the toe curved edge 68 adjacent the central facet 40, and a toe-ribbon edge 72 adjacent a portion of the ribbon 34. The toe facet 44 preferably has a third sole area that ranges from 0.75 to 2.0 square inches, and more preferably ranges 1.0 square inches to 1.5 square inches, and is most preferably 1.13 square inches. The toe facet 44 preferably occupies between 5 to 25 percent of the total sole surface area, more preferably 10 to 15 percent of the total surface area, and most preferably 13 percent of the total sole surface area.

The rear facet 46 is defined by the central arcuate edge 64 adjacent the central facet 40, a heel arcuate edge 74 adjacent a portion of the heel facet 42 and a portion of the ribbon 34, and a toe arcuate edge 76 adjacent a portion of the toe facet 44 and a portion of the ribbon 34. Preferably, the rear facet 46 has a rounded triangular shape. The rear facet 46 preferably has a fourth sole area that ranges from 1.0 to 2.0 square inches, and more preferably ranges 1.15 square inches to 1.5 square inches, and is most preferably 1.23 square inches. The rear facet 46 preferably occupies between 5 to 25 percent of the total sole surface area, more preferably 10 to 20 percent of the total surface area, and most preferably 14 percent of the total sole surface area. The total sole surface area preferably ranges from 7.0 square inches to 11 square inches, more preferably from 8.0 square inches to 9.5 square inches, and most preferably is 8.95 square inches.

Figure 3:
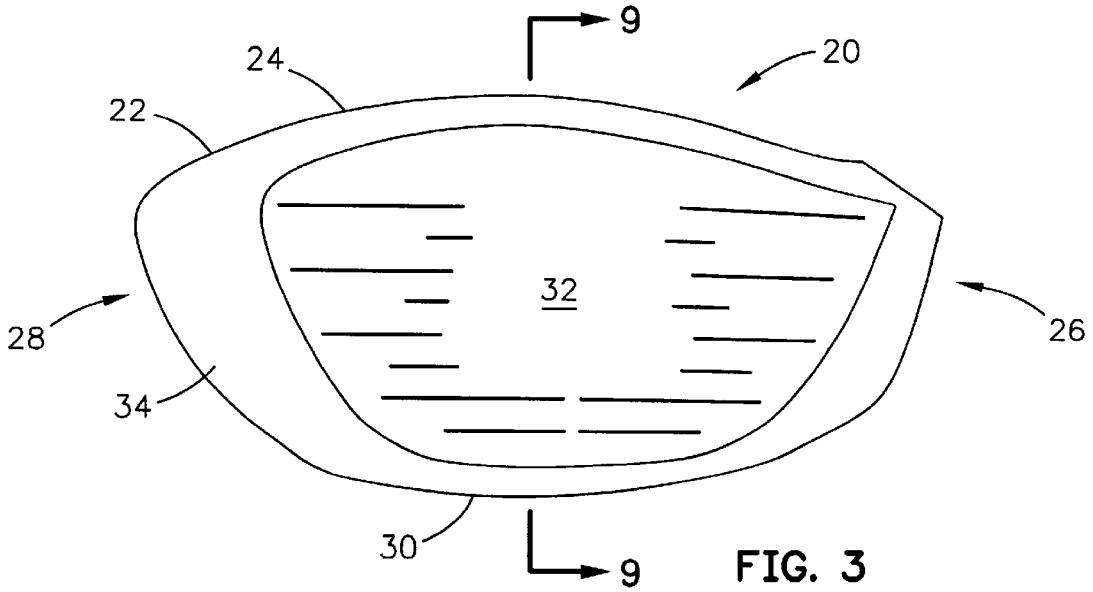
FIG. 3 is a front view of the golf club head of the present invention.
Figure 6:
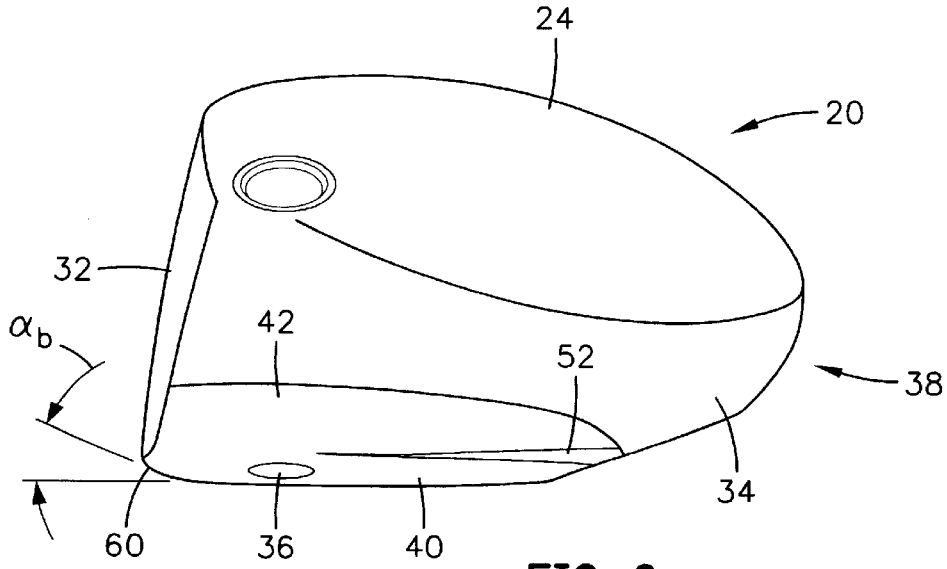
FIG. 6 is side view of the heel end of the golf club head of the present invention.
Figure 7:
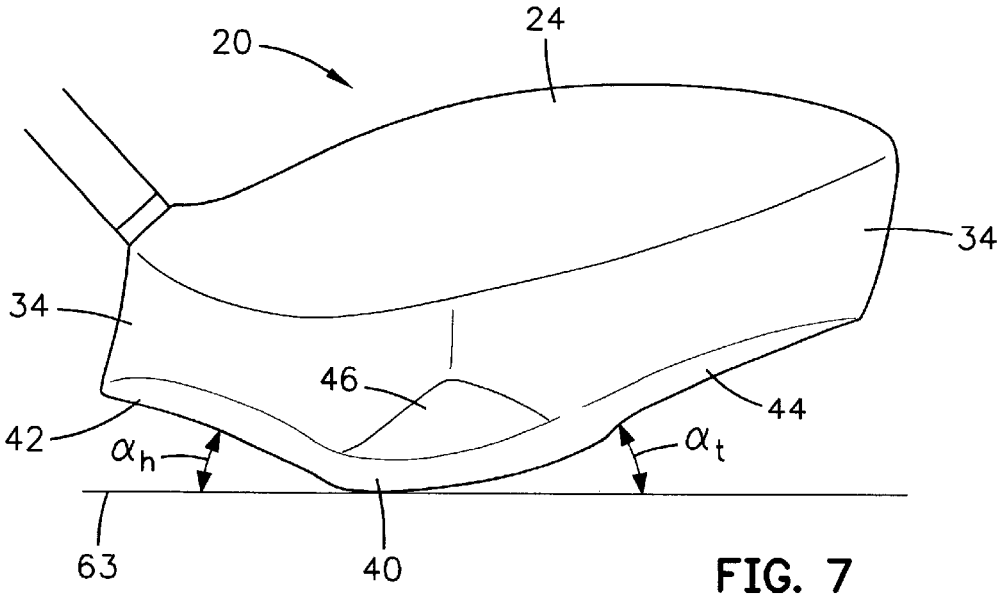
FIG. 7 is a rear view of the golf club head of the present invention.
Figure 9:
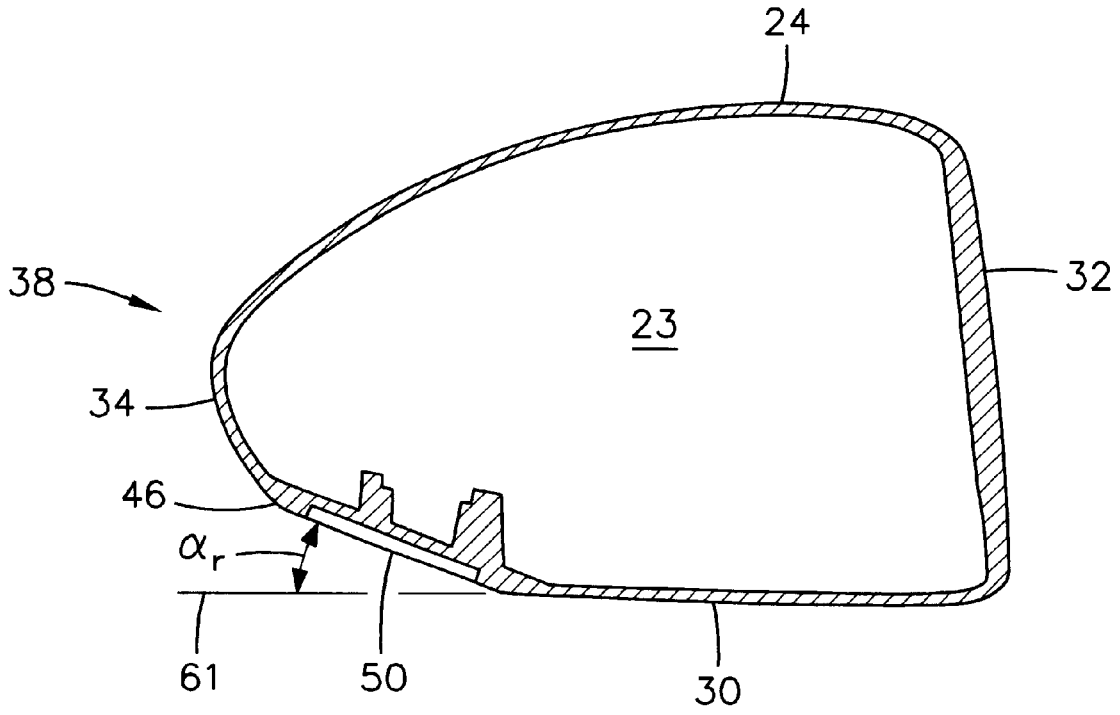
FIG. 9 is a cross-sectional view of the golf club head of the present invention along lines 9—9 of FIG. 3.

As shown in FIGS. 3, 4 and 6, the golf club head 20 has a greater width "w" than golf club heads of the prior art, with a width w of 2.2 inches to 2.4 inches. The greater width allows for a more circular striking plate 32 that requires a specific positioning of the center of gravity and a predetermined moment of inertia to provide a high performance driver or fairway wood. The sole 30 of the present invention allows for the center of gravity to be lowered for better distance and a lower spin on a golf ball after impact with the golf club head 20. The four faceted design optimizes the performance of a high performance, large volume driver or fairway wood. The central facet 40 preferably is slightly downwardly convex from the central longitudinal line 61 toward each of the heel end 26 and toe end 28. As shown in FIG. 7, the heel facet 42 and the toe facet 44 are each angled, angle $\alpha_h$ and angle $\alpha_t$ respectively, between 10 to 30 degrees relative to the central latitudinal line 63 and more preferably 20 to 25 degrees relative to the central latitudinal line 63. As shown in FIG. 9, the rear facet 44 is angled, angle $\alpha_r$, between 10 to 30 degrees relative to the central longitudinal line 61 and more preferably between 20 to 25 degrees relative to the central longitudinal line 61.

Figure 8:
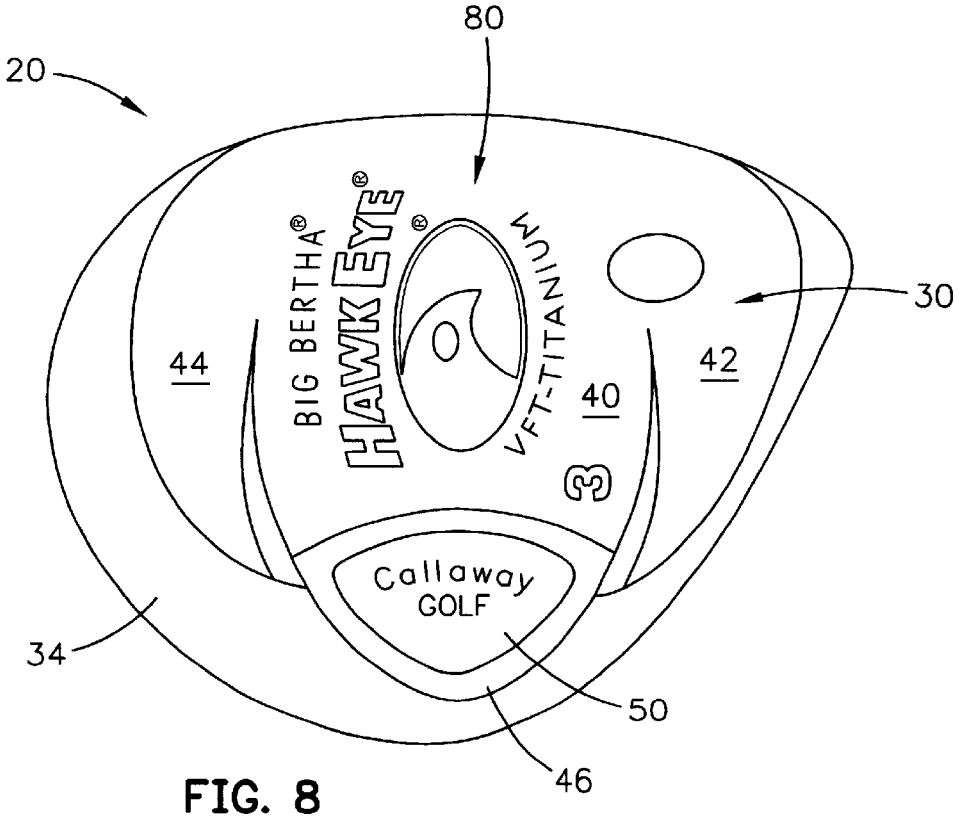
FIG. 8 is a bottom plan view of the sole of the golf club head of the present invention with indicia on the sole.

As shown in FIG. 8, the central facet 40 of the sole 30 of the present invention provides a wide canvas for engraving of indicia 80 thereon for marketing purposes. The medallion 50 of the rear facet 46 also provides a canvas or surface for marketing purposes.

Table One provides information concerning the preferable mass, center of gravity and moment of inertia for a golf club head of the present invention. Those skilled in the pertinent art will recognize that the mass, center of gravity or moment of inertia may be modified without departing from the scope and spirit of the present invention. For example, the moment of inertia may exceed 3000 g/cm$^2$ in one or more directions.

TABLE One

| | Head | Center of Gravity, in | | | Moments of Inertia, g/cm$^2$ | | |
|---|---|---|---|---|---|---|---|
| Clubhead | Mass | X | Y | Z | Ixx | Iyy | Izz |
| 07° Driver | 188.51 g | 0.683 | 0.622 | 0.948 | 2170 | 1787 | 2768 |
| 08° Driver | 188.86 g | 0.679 | 0.622 | 0.946 | 2172 | 1794 | 2780 |
| 09° Driver | 189.50 g | 0.673 | 0.624 | 0.946 | 2185 | 1815 | 2804 |
| 10° Driver | 189.13 g | 0.672 | 0.627 | 0.944 | 2194 | 1827 | 2818 |
| 11° Driver | 189.24 g | 0.662 | 0.631 | 0.944 | 2152 | 1781 | 2835 |
| 12° Driver | 189.70 g | 0.657 | 0.630 | 0.943 | 2156 | 1793 | 2850 |
| Ave. | 189.16 g | 0.671 | 0.626 | 0.945 | 2172 | 1800 | 2809 |
| Range | 1.19 g | 0.026 | 0.009 | 0.005 | 42 | 46 | 82 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A sole for a golf club head having a crown, a toe end, a heel end and a striking plate, the sole comprising:

a central facet extending rearward from the striking plate, the central facet having a first sole area;

a heel facet disposed adjacent to the central facet and having a second sole area;

a toe facet disposed adjacent to the central facet and having a third sole area; and a rear facet disposed rearward of the central facet and having a fourth sole area, the rear facet defining a recess;

whereby the first sole area is larger than the combined areas of the second sole area, the third sole area and the fourth sole area.

2. The sole according to claim 1 wherein a medallion is disposed within the recess of the rear facet.

3. The sole according to claim 1 wherein a portal to a hollow interior of the golf club bead is disposed in the recess of the rear facet.

4. The sole according to claim 1 wherein the central facet has a bounce edge having an angle ranging from 10 to 30 degrees relative to a central line of the sole.

5. The sole according to claim 1 wherein the first sole area ranges from 4.0 to 6.0 square inches, the second sole area ranges from 1.0 to 2.0 square inches, the third sole area ranges from 1.0 to 2.0 square inches, and the fourth sole area ranges from 0.5 to 2.0 square inches.

6. The sole according to claim 1 further comprising indicia engraved within the central facet.

7. The sole according to claim 1 wherein the heel facet and the toe facet are each at an angle between 10 to 30 degrees relative to a central latitudinal line.

8. The sole according to claim 1 wherein the rear facet is at an angle between 10 to 30 degrees relative to a central longitudinal line.

9. A golf club head comprising:

a body having a crown, a striking plate, a heel end, a toe end and a sole the sole comprising a central facet extending rearward from the striking plate, the central facet having a first sole area occupying 50 to 70 percent of the total sole surface area, a heel facet disposed adjacent to the central facet and having a second sole area occupying 10 to 25 percent of the total sole surface area, a toe facet disposed adjacent to the central facet and having a third sole area occupying 5 to 25 percent of the total sole surface area, and a rear facet disposed rearward of the central facet and having a fourth sole area occupying 10 to 25 percent of the total sole surface area wherein the rear facet defines a recess.

10. The golf club head according to claim 9 wherein the body is composed of a forged titanium material.

11. The golf club head according to claim 9 wherein the body has a hollow interior.

12. The golf club head according to claim 9 wherein the body has a volume greater than 300 cubic centimeters.

13. The golf club head according to claim 12 wherein the body weighs less than 200 grams.

14. The golf club head according to claim 9 further comprising a ribbon juxtaposed by the sole and the crown.

15. The golf club head according to claim 9 wherein the central facet has a bounce edge nearest the striking plate and having an angle ranging from 10 to 30 degrees relative to a central longitudinal line of the sole.

16. The golf club head according to claim 9 wherein the first sole area ranges from 4.0 to 6.0 square inches, the second sole area ranges from 1.0 to 2.0 square inches, the third sole area ranges from 1.0 to 2.0 square inches, and the fourth sole area ranges from 0.5 to 2.0 square inches.

17. The golf club head according to claim 9 wherein the heel facet and the toe facet are each at an angle between 10 to 30 degrees relative to a central latitudinal line.

18. A golf club head comprising:

a body having a volume greater than 300 cubic centimeters, having a hollow interior, and having a crown, a striking plate, a ribbon, a heel end, a toe end and a sole, the sole comprising a central facet extending rearward from the striking plate, the central facet having a first sole area having an area ranging from 4.0 to 6.0 square inches, a heel facet disposed adjacent to the central facet, angled toward the ribbon relative to the central facet, and having a second sole area having an area ranging from 1.0 to 2.0 square inches, a toe facet disposed adjacent to the central facet, angled toward the ribbon relative to the central facet, and having a third sole area having an area ranging from 1.0 to 2.0 square inches, a rear facet disposed rearward of the central facet, angled toward the ribbon relative to the central facet, and having a fourth sole area having an area ranging from 0.5 to 2.0 square inches, wherein the rear facet defines a recess, and a medallion disposed within the recess of the rear facet.

19. The golf club head according to claim 18 wherein the golf club head is composed of a material selected from the group consisting of titanium, titanium alloy and steel.

* * * * *